United States Patent [19]

Kennedy

[11] 3,992,610

[45] Nov. 16, 1976

[54] WEIGHT AND BALANCE CALCULATOR

[76] Inventor: Jerry L. Kennedy, Southern Illinois Airport, Carbondale, Ill. 62901

[22] Filed: July 7, 1975

[21] Appl. No.: 593,246

[52] U.S. Cl. ..... 235/61 T; 235/83

[51] Int. Cl.[2] ..... G06G 1/14; G06G 1/16

[58] Field of Search ..... 235/61 T, 77, 79.5, 235/83, 84, 115, 122

[56] References Cited

UNITED STATES PATENTS

| | | | |
|---|---|---|---|
| 2,193,280 | 3/1940 | Gunning | 235/61 T |
| 2,373,566 | 4/1945 | Imm | 235/61 T |
| 2,432,738 | 12/1947 | Fairbanks | 235/61 T UX |
| 2,559,718 | 7/1951 | Goodlett et al. | 235/61 T UX |
| 2,636,270 | 4/1953 | McDonald et al. | 235/61 T UX |
| 2,782,986 | 2/1957 | Davey | 235/61 T |
| 3,012,715 | 12/1961 | Saunders | 235/61 T |
| 3,059,848 | 10/1962 | Moen | 235/61 T UX |
| 3,086,703 | 4/1963 | Germack | 235/61 T |
| 3,375,974 | 4/1968 | Naber et al. | 235/61 T |

*Primary Examiner*—Stanley J. Witkowski
*Attorney, Agent, or Firm*—Cushman, Darby & Cushman

[57] ABSTRACT

The disclosure embraces a manually operated weight and balance calculator for use with a slide card containing a graphic display of the weight-balance tolerance characteristics for a particular type of aircraft; the calculator includes a carrier channel for movably supporting a card in a selected position; spaced apart arcuate portions are provided for rotatably retaining a flat disc member; the disc member is provided with an outer rim portion which carries markings thereon alignable with markings formed on one of the arcuate portions; the disc member is provided with a central portion which is transparent to permit observation of a card supported by the calculator; the transparent portion is also provided with a plurality of parallel slots which permit access to the card carried by the calculator for the purpose of placing a series of markings on the card which are characteristic of the magnitude and position of the loads being carried by the aircraft and which will permit visual observation of the effect of changes in the magnitude and position of the loads relative to the weight and balance tolerances of the aircraft.

5 Claims, 3 Drawing Figures

| | | | | | |
|---|---|---|---|---|---|
| SEATS | 142 | 350° | NOSE BAG | 022° |
| | 344 | 342° | WING BAG | 335° |
| | 546 | 331° | MAINS | 348° |
| | 748 | 323° | AUX. | 345° |
| | 9410 | 316° | | |

| | | | | |
|---|---|---|---|---|
| SEATS | 1+2 | 355° | NOSE BAG | 027° |
| | 3+4 | 339° | WING BAG | 333° |
| | 5+6 | 328° | MAINS BAG | 348° |
| | 7+8 | 319° | AUX. | 344° |

CESSNA 411

WEIGHT AND BALANCE CALCULATOR

BACKGROUND AND SUMMARY OF THE INVENTION

The present invention relates to weight and balance or moment calculators and, more particularly, to calculators used with small aircraft to determine whether the load the aircraft is carrying is properly disposed for a safe flight.

The necessity of properly distributing loads is particularly important for small aircraft such as are used in short commuter flights or for specific charter purposes where the passenger capacity ranges from as few as 4 to up to 12 seats. Additionally, as is well known, fuel consumption can alter the weight-moment balance of some types of small aircraft and this must be compensated for in order to insure a safe flight particularly where wind conditions are adverse.

As a consequence of the necessity of properly distributing the loads in a small aircraft, a variety of different types of calculators have been proposed for use by pilots in order to facilitate the disposition of loads in such aircraft. One particular type of calculator is of the kind which makes advantageous use of graphs provided by the aircraft manufacturer which displays what is termed the "moment envelope" which displays a tolerance characteristic of a specific type of aircraft. Such prior art devices, as well as others, do not readily lend themselves to use where frequent changes in the load dispositions in an aircraft occur such as on small commuter planes or short cargo hauls. Specifically, a number of the known calculators require the pilot to completely recalculate the weight-balance tolerance should any large alteration in the load occur such as the discharge of one or more passengers or, in some cases, even the filling or emptying of one of the fuel tanks or bags.

As is well known, small aircraft operators, of necessity, must operate on tight schedules in order to remain competitive and, accordingly, the need for a device that can rapidly and accurately calculate weight-moment tolerances is evident in order to minimize interference with flight schedules and assure a safe load disposition for the flight.

Accordingly, it is an object of the present invention to provide a weight balance calculator that will eliminate the necessity for any arithmetical calculations as well as one which will efficiently utilize the moment envelope graph provided by the aircraft manufacturer so as to enable the pilot to rapidly determine any variations in the weight moment tolerance due to loading or unloading during a flight stopover. Additionally, the calculator of the present invention will enable the pilot to determine precisely the extent to which a load should be shifted in order to bring the weight-moment balance within the tolerance of the aircraft.

In a preferred embodiment, the present invention utilizes a modification of the standard flight computer or calculator which is conventionally employed to resolve wind vector flight plottings. The standard flight calculator consists of an outer support member carrying a range of indicia markings in angular degrees and an inner movable dial or disc member which is circular and is divided into 360° increments corrsponding to flight or wind directions. According to the present invention, the central portion of the inner disc is provided with a transparent section. In this section there are formed a plurality of parallel slots with a central slot extending across a diameter of the section. Additionally, a slotted channel is provided on the underside of the calculator to receive and support a card carrying a moment envelope graph characteristic of a particular aircraft.

As will be explained in more detail hereinafter, with the foregoing device, knowing the magnitude of the weights being placed in an aircraft, a pilot will be able to rapidly plot in an accurate manner the sum of the vectors representing the moment arms of the loads to be carried by the aircraft. Moreover, the changes in the loads can be immediately determined by simple visual inspection of the plotted graph relative to the moment envelope which will indicate to the pilot whether any rearrangement of the load is necessitated by any additions or subtractions to the aircraft cargo.

The calculator of the present invention will permit more rapid and accurate calculations of weight-moment tolerances than has previously been possible and will eliminate the necessity of carrying out intricate mathematical computations in order to arrive at a safe tolerance determination. Further advantages will become apparent as consideration is given to the following detailed description and accompanying drawings, in which:

DETAILED DESCRIPTION OF THE INVENTION

Figure 1:
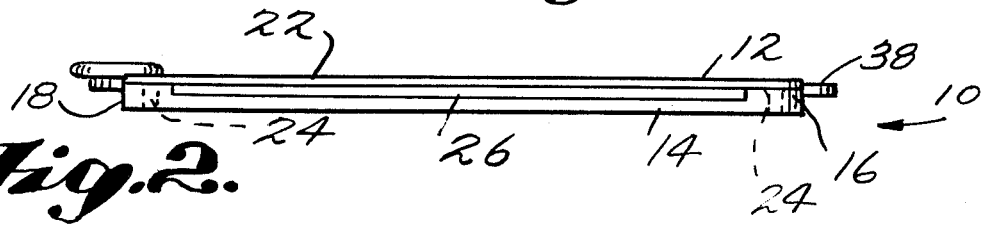
FIG. 1 is an end view of the calculator of the present invention.
Figure 2:
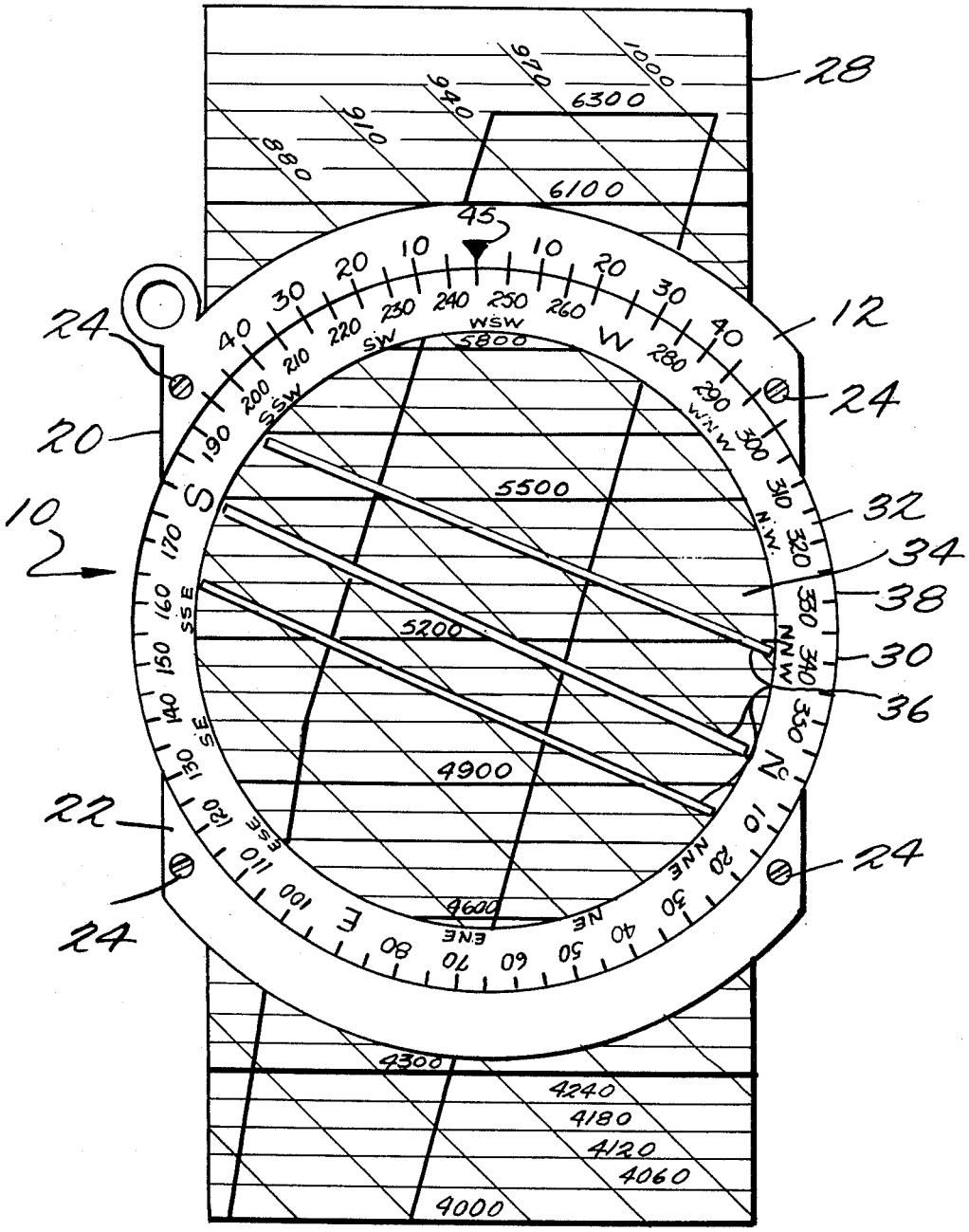
FIG. 2 is a top plan view of the calculator of FIG. 1 with a moment envelope card carried thereby.

Referring now to the drawings, there is illustrated in FIGS. 1 and 2, the weight balance calculator of the present invention generally designated at 10. Calculator 10 resembles the conventional flight calculator used for resolving wind vector problems, as previously noted.

The calculator 10, as shown in FIG. 1, has a top surface or face 12 and a flat under surface or wall 14. At opposite ends of the wall 14, on either side thereof, there are provided raised portions 16 and 18. Secured to the raised portions 16 and 18 are retaining means in the form of arcuately shaped, flat plate members 20, at one end, and 22 at the other end of the wall 14. The plates 20 and 22 may be secured in any conventional manner to the raised portion 16, such as by the threaded screws 24 as shown.

With the plates 20 and 22 secured as illustrated, a narrow, slot-like channel 26 is provided in the calculator 10 which extends the length of the calculator. There is thus provided a carrier means for sheet-like material such as card 28 which may be inserted in channel 26 and supported between the wall 14 and the plates 20 and 22. The size of the channel 26 is such that the card 28 will be slidable therein.

Disposed between plates 20 and 22 and lying coplanar therewith, is a disc member 30 which has a peripheral opaque portion forming an annular ring or rim 32. Inscribed on the face of the rim 32 are degree markings in five degree increments. Within the rim 32, there is located a transparent plate segment 34. The plate segment 34 may be made of plastic material and is formed with a series of slots, three of which are illustrated at 36. In a preferred embodiment, one of the slots will extend across the diameter of the plate segment 34, along the north, south axis of the degree markings. Also, it is preferable to provide an equal number of slots extending parallel to the slot 36 on either side of the central slot 36 and consecutive slots preferably being equally spaced, to facilitate the use of the device as will be explained below.

Transparent plate segment 34 is, of course, securely fastened to the opaque rim 32 by any suitable means such as an adhesive or, where the elements are made from plastic, by localized melting and welding of the plastic materials. The disc member 30 is retained by the plate members 20 and 22, preferably, by a friction fit which will permit rotation of the disc member 30 relative to the plates 20 and 22. For this purpose, a section of the disc member as at 38 projects beyond the ends of the plates 20 and 22 to provide ease of access for manipulating the disc 30 relative to the plates 20 and 22 and also for the purpose of facilitating removal of the disc 30, for the purpose of cleaning the device.

An explanation of the use of the calculator 10 will now be given.

Figure 3:
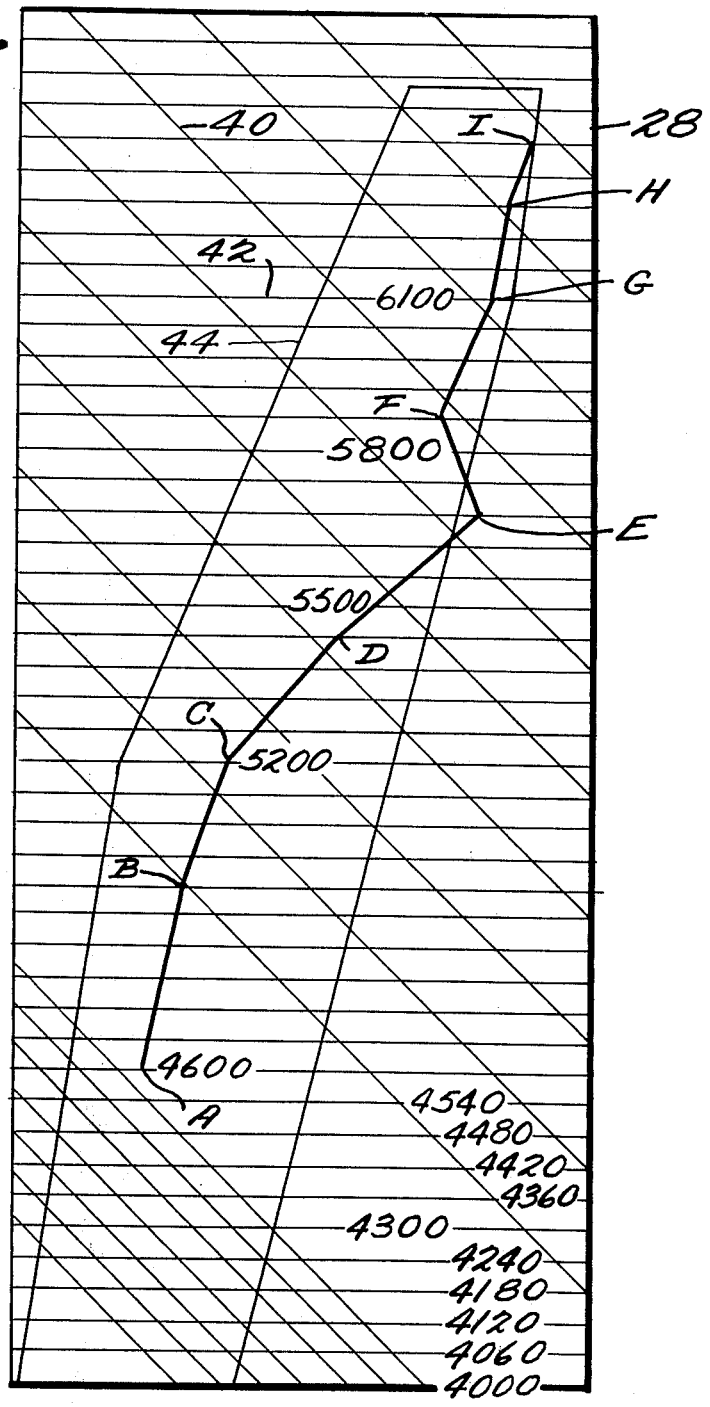
FIG. 3 is a plan view of a moment envelope card on which has been plotted a completed weight balance calculation using the device of the present invention.

As mentioned above, aircraft manufacturers provide moment envelope graphs, such as are illustrated at 28 in FIG. 2 and in FIG. 3. Referring to the graph of FIG. 3, the moment arms are indicated by the diagonal line such as at 40, while the weight increments are indicated by the horizontal lines such as at 42, which indicates 6,100 pounds. By a series of computations taking into consideration the location of the center of lift of the aircraft, and the empty weight center of gravity, for a particular aircraft, the manufacturer arrives at a range of tolerances represented by the envelope designated by line 44.

As is apparent, upon loading an aircraft, the center of gravity of the aircraft will shift, depending on the positions and magnitudes of the loads. Since the center of gravity of the empty aircraft (no fuel or passengers) will always have the same location, the addition of loads either in the form of passengers, fuel or cargo at predetermined locations in the aircraft body will have a constant angular relationship to the center of gravity of the aircraft when empty. For example, in the body of an aircraft having fixed seats for carrying passengers, any given seat will have a determined angular relationship to the empty aircraft's center of gravity. The same, of course, applies to each cargo location for baggage and each fuel tank. Although the indicia on plate 30 of the preferred embodiment illustrated in the drawings are marked in degrees due to the use of a standard flight calculator which has been modified to produce the apparatus of the present invention, it is to be understood that any regularly spaced sequence of indicia may be used around the circumference of disc 30 to indicate the desired angular setting of the slots 36 relative to the moment envelope graph 28. It is this angular setting that is important and the 355 degree indicia associated with seats 1&2 in FIG. 3 has no relevance other than to provide a mark along the periphery of disc 30 which can be aligned with a predetermined mark 45 on plate 20 to place the slots 36 at the appropriate angle. Likewise, the other indicia shown on plate 20 has not relevance to the present invention with the exception of mark 45. The angle of each moment vector for each seat or other weight positioning location can easily be calculated in a well known manner and, as mentioned above, will never vary for a given airplane. As is well known, the only thing about the moment vector that will vary is its length due to a weight change, not its angle. Thus, the moment envelope graphs shown in FIGS. 2 and 3 can be provided with this information as illustrated at the lower portion thereof, for each weight location.

The information given on the bottom portion of FIG. 3, for example, indicates the indicia on disc 30 to be aligned with mark 45 to place the slots 36 at the correct angle for the weight position moment vector being considered. In addition to the angles of the moment vectors for each seat, it is necessary to provide the same information for the forward luggage compartment referred to as "vase bag" in FIGS. 2 and 3 and for the full tanks, referred to as "wings", "mains", and "aux", so that appropriate adjustments can be made as fuel is used or added. Thus, the table appearing below the moment envelope graph of FIG. 3 can be utilized in conjunction with a device of the present invention to rapidly calculate and display the relationship of the individual loads as well as the combined loads relative to the weight-balance tolerance represented by the moment envelope 44. This is done as follows:

Referring to FIG. 3, point A which is previously determined by the aircraft manufacturer indicates the empty weight (4600 lbs.) and center of gravity of the particular aircraft, for example, the Cessna 411. The person making the calculation then estimates the total weight occupied by seats 1 and 2 of the aircraft which, for this examples, is selected as 360 lbs. With the moment envelope graph card inserted in the calculator 10 as illustrated in FIG. 2, using the table appearing at the bottom of FIG. 3, for the Cessna 411, the user will rotate the disc member 30 to bring the angular marking 355 degrees in alignment with the zero marking 45 on the plate 20. As a result, all of the slots 36 will then extend at the desired angular relationship to the arbitrarily selected zero axis represented by the mark 45 on the plate 20. Next, the card 28 is shifted to bring the point A under one of the slots 36. The operator then inscribes, as with a pencil, a straight line guided by the slot on the graph 28, the line having a length corresponding to 360 lbs., to the point B in FIG. 3. Next, the magnitude of the weight in seats 3 and 4 is determined and then the angular marking of 339 degrees is brought into alignment with the zero mark at 45 on the plate 20. A second line is inscribed which, for illustration, corresponds to a weight of 240 lbs., as indicated at point C.

The foregoing manipulations are continued through point D corresponding to the magnitude of the weights in seats 5 and 6 and point E corresponding to the weight in seats 7 and 8. It will be noted that point E lies outside of the envelope 44. However, point F corresponding to the magnitude of the weight in the nose baggage compartment brings the sum of the vectors A through F back within the envelope 44, corresponding to a safe flying condition.

The remaining points, G, H and I complete the calculation corresponding to the wing baggage compartment, main and auxiliary gas tanks. Since point I lies within the envelope 44, the weight balance characteristic of the aircraft is safe for take-off and flight.

The plottings represented in FIG. 3 immediately tell the pilot that baggage located in the nose compartment should not be removed until either the passenger or passengers in seats 7 and 8 are shifted or depart the plane, since the vector FE corresponding to the baggage in the nose compartment brings the weight balance moment back within the safe limits denoted by the envelope 44.

A pilot can easily compensate for the departure of a passenger such as at a stop-over, as follows. Assuming that the passengers in seats 5 and 6 depart from the plane, as a result, vector CD will be eliminated. Elimination of the vector can be performed in the reverse of adding a vector. Rotate the disc member 30 to bring the angular marking 328 degrees in alignment with the zero marking 45 on the plate 20. Next the card 28 is shifted to bring the point I under one of the slots 36. The operator then inscribes, as with a pencil, a straight line guided by the slot on the graph 28, the line having a length corresponding to the magnitude of the weight in seats 5 and 6 that is being eliminated.

The effect of subsequent changes in the load distribution can then be calculated with respect to the endpoint of the last vector that has been plotted, whether it be the addition or subtraction of a vector.

Having described the preferred embodiment of the present invention, it will be understood that modifications may be made therein without departing from the spirit and scope of the present invention, as defined in the appended claims.

What is claimed is:

1. A manually operated weight and balance calculator for determining load position tolerances in an aircraft, said calculator having one side and another side, said one side including carrier means for flat sheet material containing indicia characteristic of a selected aircraft, said other side of said calculator including disc member retaining means having a portion for carrying indicia markings, a circular disc member rotatably retained by said retaining means so that said disc member is rotatable relative to said retaining means about an axis which extends substantially perpendicular to the sheet material when the sheet material is carried by said carrier means, said disc member having a portion for carrying indicia markings selectively alignable with indicia markings on said portion of said retaining means by relative rotation of said disc member and retaining means, said disc member further including a transparent plate member, said plate member having a slot formed therein of a size sufficient to permit access to sheet material carried by said carrier means to place markings on the sheet material.

2. The calculator as claimed in claim 1 wherein said portion for carrying indicia markings of said disc member is an annular ring having a radial width sufficient to carry the indicia markings and said transparent plate member is a planar disc surrounded by said annular ring.

3. The calculator as claimed in claim 2 wherein said slot extends along a diameter of said planar disc.

4. The calculator as claimed in claim 3 wherein a plurality of additional slots are provided in said planar disc, extending parallel to said slot.

5. The calculator as claimed in claim 4 wherein consecutive ones of said slot and said plurality of additional slots are disposed with equal spacing between them.

* * * * *